US005423516A

United States Patent [19]

Blaha

[11] Patent Number: 5,423,516

[45] Date of Patent: Jun. 13, 1995

[54] FISH TAPE REEL

[75] Inventor: William E. Blaha, St. Charles, Ill.

[73] Assignee: Ideal Industries, Inc., Sycamore, Ill.

[21] Appl. No.: 178,468

[22] Filed: Jan. 6, 1994

Related U.S. Application Data

[63] Continuation of Ser. No. 933,671, Aug. 24, 1992, abandoned.

[51] Int. Cl.[6] ..... B65H 59/00

[52] U.S. Cl. ..... 254/134.3 FT

[58] Field of Search ..... 254/134.3 FT, 134.3 R, 254/403, 411, 333; 242/96, 71.1; 15/104.33, 104.31

[56] References Cited

U.S. PATENT DOCUMENTS

| | | | |
|---|---|---|---|
| Re. 24,250 | 12/1956 | Waldschmidt . | |
| 648,044 | 4/1900 | Miller | 242/96 |
| 961,510 | 6/1910 | Mack | 254/411 |
| 1,815,433 | 7/1931 | Dunagan | 254/134.3 FT |
| 1,956,806 | 5/1934 | Mitzen et al. | 254/134.3 FT |
| 2,672,303 | 3/1954 | Smith | 242/96 |
| 2,689,709 | 9/1954 | Waldschmidt . | |
| 2,731,894 | 1/1956 | Leitz et al. | 242/71.1 |
| 2,750,152 | 6/1956 | Schinske . | |
| 2,788,952 | 9/1959 | Axelsen . | |
| 3,424,435 | 1/1969 | Niemann . | |
| 3,528,644 | 9/1970 | Scott . | |
| 3,549,106 | 12/1970 | Stark | 242/71.1 |
| 3,549,127 | 12/1970 | Niemann . | |
| 3,568,947 | 3/1971 | Oprins . | |
| 3,601,330 | 8/1971 | Minobe . | |
| 4,092,780 | 6/1978 | Trethewey . | |
| 4,466,581 | 8/1984 | Hill | 242/96 |
| 4,520,239 | 5/1985 | Schwartz | 242/96 |
| 5,056,731 | 10/1991 | Koehn . | |
| 5,110,092 | 5/1992 | Blaha et al. . | |

*Primary Examiner*—Robert C. Watson

*Attorney, Agent, or Firm*—Dorn, McEachran, Jambor & Keating

[57] ABSTRACT

An electrician's fish tape and reel therefore has an annular outer race and an annular hub rotatably mounted within the inside diameter of the race. Together the race and hub define a fish tape receiving chamber. A fish tape in the chamber is coiled on the hub with its inner end anchored to the hub. Springs bias the fish tape away from the race to prevent it from uncoiling against the race. The outer end of the tape extends out of the reel through a fixed opening in the outer race. A handle fixed to the race and a knob pivotably mounted on the hub permit a user to rotate the hub and thereby wind the fish tape into or out of the reel.

17 Claims, 2 Drawing Sheets

FISH TAPE REEL

This is a continuation of application Ser. No. 07/933,671 filed on Aug. 24, 1992, now abandoned.

BACKGROUND OF THE INVENTION

This invention relates to reels for electrician's fish tape. A fish tape is a somewhat rigid but substantially flexible elongated member used by electricians for installing wires in conduit. Wires not having sufficient rigidity to allow them to be simply pushed through a conduit must be installed using a fish tape. The fish tape has sufficient strength and flexibility to be threaded or "fished" through a conduit. The electrician then attaches one or more wires to the free end of the tape, and pulls the other end of the tape back out of the conduit, leaving the wires in place.

Fish tape materials range from spring-steel, rectangular wire for maximum strength to highly flexible wound wire to fiberglass cores having a plastic sheath. Wound wire fish tapes and fiberglass/plastic tapes are available from the present assignee, Ideal Industries, Inc., under their trademarks Goldfish®and S-Class®, respectively. Tapes typically are sold in lengths of 50, 100 or 200 feet. Naturally tapes of this length have to be coiled to be manageable. But the natural resilience of the tape materials resists being constrained in a neat coil. The tape always seeks to uncoil, somewhat in the nature of a mechanical watch spring. Various cases and reels have been used to house a fish tape, with assorted arrangements for paying the tape out of the case during use.

Prior art reels typically use the inside surface of an outer peripheral wall of the reel to constrain the coil. This wall is circumferentially split to define a slot extending around the reel to allow the tape to be extracted from the reel. The halves of the wall normally meet to enclose the coiled tape but they are flexed or spread apart by a winder at the point where the tape exits. The winder can be pushed or pulled around the circumference of the reel to pay out the outer end of the tape. Thus, in essence, the exit opening in the reel moves around the periphery of the reel. U.S. Pat. No. 3,424,435 shows an example of this type of reel.

With the tape constrained by the outer peripheral wall in this type of reel, it is not possible to wind the coil about an interior hub. This means the tape is unmovable relative to the outer wall and necessitates the split or slotted reel technique for getting the tape in and out. Another problem with this reel is the necessity of putting a drag or tension load on the tape as it enters or exits the reel. Tension is required to insure the tape will coil tightly in the storage compartment of the reel. The winders may have a curved or indirect path for the tape passing therethrough for this purpose. This intentional drag or friction on the tape increases the physical effort required to wind the tape, thereby increasing the time it takes with a consequent decrease in productivity.

SUMMARY OF THE INVENTION

The present invention concerns an electrician's fish tape and reel therefore. A primary object of the invention is an improved fish tape reel which allows easier and faster coiling and uncoiling of the tape.

Another object of the invention is a fish tape reel having a fixed handle on the outside of the reel.

Yet another object of the invention is a fish tape reel having a fold-down knob or crank for turning a rotatable hub.

A further object of the invention is a fish tape reel having the inner end of the tape anchored to the reel and the outer end extending out of the reel.

A still further object is a fish tape reel wherein the outer end of the tape is payed straight out of the reel with no drag or friction on the tape.

These and other objects are realized by a fish tape reel in which the tape is wound on the outside diameter of a hub. The hub is rotatably mounted interiorly of an annular outer race. Springs attached to the interior of the race's outer periphery bias a steel tape radially inwardly and prevent it from uncoiling against the race. The springs may optionally be removed for wound wire or fiberglass/plastic tapes. The inner end of the tape is anchored to the rotatable hub and the outer end of the tape extends tangentially out of the coil, more or less straight through an aperture in the outer race.

A stationary handle is fixed to the outside of the race. A knob is pivotably attached to the hub and is movable between a lowered, storage position and a raised, operating position. A user can readily hold the handle with one hand and the knob with the other to rotate the hub and cause the tape to move into the reel.

DETAILED DESCRIPTION OF THE INVENTION

Figure 1:
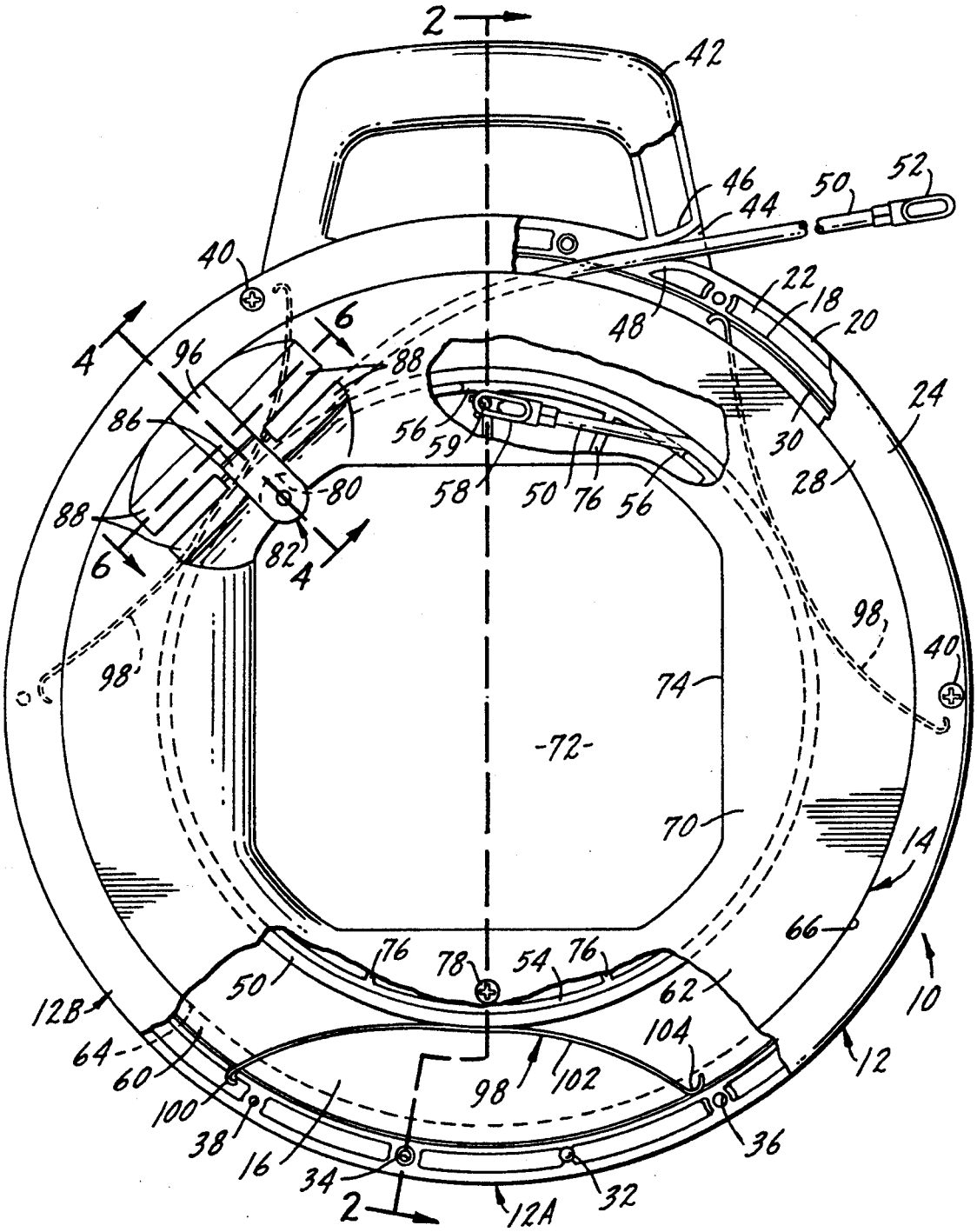
FIG. 1 is a side view of the fish tape reel with portions cut away.

FIG. 1 shows a fish tape reel or housing generally at 10. The reel 10 is made up of two basic parts, an annular outer race 12 and a hub 14. The hub 14 is smaller in diameter than the outer race and of an appropriate size so that it will fit inside of the outer race 12. The race and hub interfit such that they are rotatable with respect to one another and cooperatively define a fish tape receiving chamber 16. Preferably the race and hub are made of high impact ABS, although other materials could be used.

Figure 2:
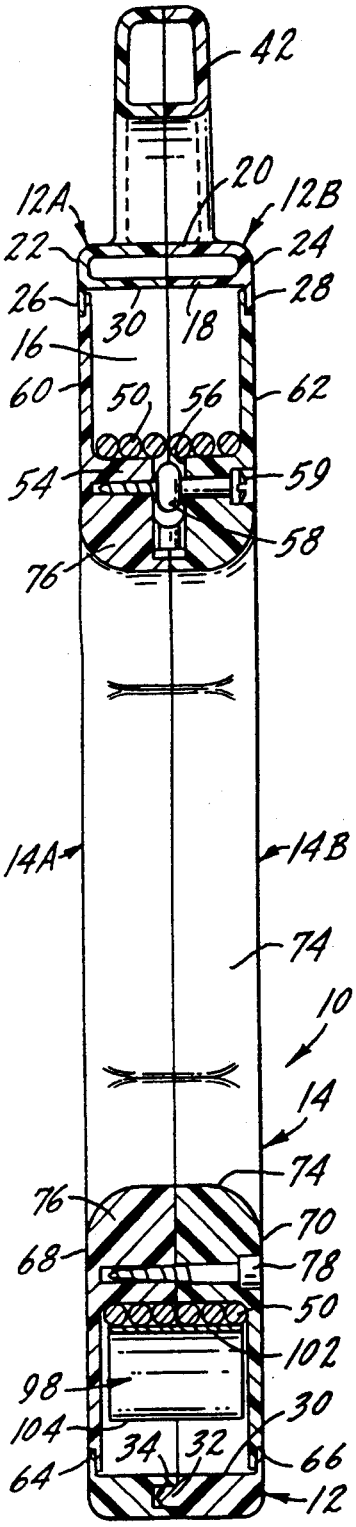
FIG. 2 is a section taken along line 2—2 of FIG. 1.
Figure 3:
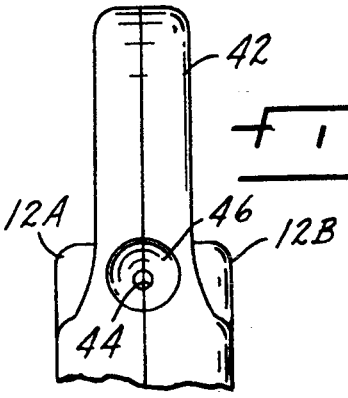
FIG. 3 is an end view of the handle, looking into the aperture through which the tape extends.

As shown in FIG. 2, the race 12 is made of two identical halves 12A and 12B. The halves are symmetrical about a vertical centerline which generally coincides with the section line 2—2 of FIG. 1 (except at the bottom where the section line jogs). The race has concentric inside and outside annular walls 18 and 20 which are held in spaced relation by radial side walls 22 and 24. The side walls have extensions 26, 28 extending inwardly of the inside wall 18. The inner surface 30 of the inside wall 18 defines the outer peripheral extent of the chamber 16.

The annular walls 18 and 20 are also joined by a series of ribs which have four different configurations. One type of rib has a locating peg 32. The peg aligns with a rib on the other race half having a socket 34. The peg and socket combination aligns the race halves. Another type of rib has a bore 36 for receiving a screw. This rib mates with a rib having a screw anchor 38. The various ribs are spaced around the race. The race halves are clamped together with screws 40 which fit through bores 36 and are threaded into anchors 38.

A handle 42 is fixed to outside wall 20 of the race 12. Preferably it is integrally formed with the wall. At the base of the handle, where it joins wall 20, is an aperture 44 defined by a flaring partition 46 in the handle and a depressed partition 48 in the race. It can be seen that partitions 46 and 48 define discontinuities in the race's walls 18 and 20. These discontinuities provide access to the tape receiving chamber 16. The outer end of a round, fiberglass fish tape 50 with eyelet 52 is shown in FIG. 1 extending through aperture 44. Since the race halves are symmetrical it will be realized that there are two apertures in the race, only one of which is used. Also, the eyelet is necessary only with wound wire or fiberglass tapes. The steel tape simply has a loop bent at the end of the tape.

The aperture 44 may be described as a fixed aperture because it remains fixed with respect to the rest of the outer race. The aperture is always located at the base of the handle and the handle is fixed to the outer wall 20. Actually, the handle is molded into the rest of the race.. The fixed aperture and handle of the present invention contrast with prior art reels that have what may be called a traveling handle that moves around the circumference of the outer wall, opening a traveling aperture as it goes.

Turning now to details of the hub 14, FIG. 2 illustrates that like the outer race 12, the hub is formed of two identical halves 14A, 14B. Each half is symmetrical about a line coinciding with section line 4—4. The hub has a circular core 54. The core has a slot 56 along a segment thereof for receiving the inner end of the fish tape and its associated eyelet 58. An anchor 59 in the form of a screw retains the eyelet in the hub.

The hub further includes two radial side walls 60 and 62 adjoining the core 54 and extending outwardly therefrom. Together the walls 60, 62 and core 54 form a generally U-shaped cross-section, as seen in FIG. 2. This cross-section, together with the inside wall 18 of the race, defines the chamber 16. The outer edges of the walls 60, 62 have notches 64, 66 which receive the extensions 26, 28 of the race in interfitting relation. This engagement of the walls and extensions makes the hub 14 rotatable within the race 12.

A pair of interior radial side surfaces 68, 70 extend from the core 54 inwardly to an eight-sided center opening 72. The surfaces 68, 70 are joined at the opening by a generally axial closure member 74. The intersections of the surfaces 68, 70 with the closure member 74 have relatively large radii making it comfortable to grab the reel through the opening 72 if desired. The surfaces 68, 70 are strengthened by a series of ribs 76. Some of the ribs have holes for screws 78 which hold the two hub halves together.

Figure 7:
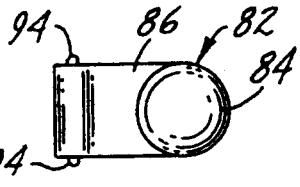
FIG. 7 is a plan view of the knob.
Figure 4:
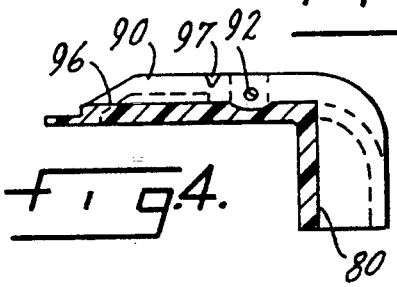
FIG. 4 is a section taken along line 4—4 of FIG. 1, with the knob removed.
Figure 5:
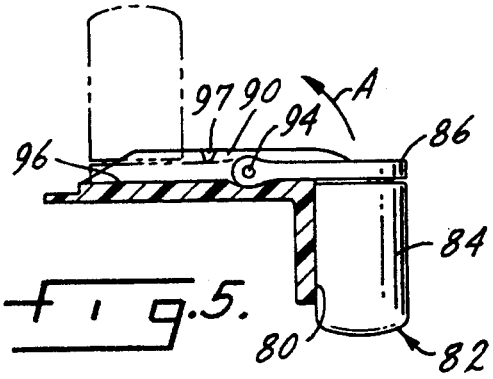
FIG. 5 is a view similar to FIG. 4, with the knob installed and shown in its storage position and, in phantom lines, in its operating position.

In one corner of the opening 72 the closure member 74 is indented to form a socket 80 (FIGS. 1 and 4). The socket provides a storage position for a knob 82 (FIG. 5). The knob comprises a grip 84 which is rotatably mounted on a crank arm 86. The crank arm in turn has mold-in extensions or pins 94 (FIG. 7). The pins allow the knob to pivot (as indicated by arrow A in FIG. 5) between a lowered, storage position and a raised, operating position. The knob is shown in its operating position in phantom lines in FIG. 5.

Figure 6:
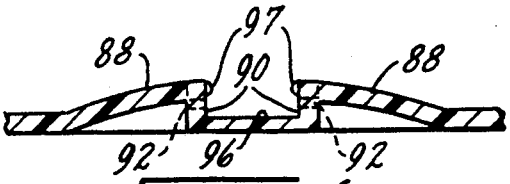
FIG. 6 is a section taken along line 6—6 of FIG. 1.

As seen in FIGS. 4 and 6, the hub side wall has upraised ledges 88 terminating at vertical shoulders 90. Holes 92 in the shoulders receive the crank arm pins 94. The shoulders extend downwardly to an adjoining floor 96. Shoulders 90 and floor 92 define a channel or groove in which the crank arm rests. The channel structure has sufficient strength to allow the knob to rotate the entire hub when a user rotates the knob. Nubs 97 extend from the shoulders slightly into the channel to provide a snap fit arrangement for the knob and channel. This prevents the knob from wiggling around when it is in the operating position.

Because the hub is made of two identical halves, it will be realized that the channel structure exists on both sides of the hub. Only one of the channels has a knob installed; the other one is empty. But the crank arm may be releasably installed in the holes, allowing the knob to be switched from one channel to the other, accommodating left or right-handed users.

Spring means are disposed within the chamber 16 for biasing a steel fish tape away from the surface 30 of the outer race. In the embodiment of FIGS. 1 and 2 the springs means are three bowed leaf springs 98. Each spring 98 has a curved head 100, and elongated body 102 and a curved foot 104. The head is locked in a slot or notch formed in inside wall 18. The body curves into the chamber and engages the coils of the fish tape, forcing the tape toward the core 54. The foot 104 slidingly engages the surface 30 of the race wall 18. As seen near the bottom of FIG. 2, the width of the spring is only slightly less than the width of the chamber 19.

It will be understood that other suitable spring means could be used so long as they are effective to overcome the natural tendency of the tape to remain straight by uncoiling. It is the job of the spring means, in whatever form, to prevent uncoiling and the force the tape to remain coiled on the outside diameter of the hub's core. Also, the spring means may optionally be deleted when the tape is of the wire wound or fiberglass/plastic type. These materials are limber enough to stay in place without the springs. A steel fish tape, however, requires the use of the spring means.

Assembly of the reel is as follows. One of the race halves, say 12A, is laid flat with its interior side up. Hub half 14A is placed on the race half 12A with notch 64 engaging extension 28. A coiled fish tape held together by frangible ties is placed around core 54 of the hub half 14A. Interior eyelet 58 is placed in slot 56 and aligned with the anchor hole. The exterior end of the tape is threaded through the half of the aperture defined by race half 12A. The springs 98 are laid into the slots in race half 12A. They will have to be flexed to accommodate the fish tape.

Next hub half 14B is aligned with half 14A and screwed in place by screws 78. Anchor screw 60 is installed. Race half 12B is then aligned to half 12A. This alignment involves fitting spring heads 100 in their race slots, pegs 32 in sockets 34 and extension 28 in notch 66. Once aligned, the race halves are secured by screws 40. Finally, knob 82 is pinned to one of the channel structures.

The use of the fish tape reel is as follows. To extend the tape out the user can grasp the handle 42 and simply pull on the end of the tape. Upon initial use of a new tape the ties holding the tape coiled will break, allowing the tape to pay out of the reel. At this point the springs 98 will bias the coils of the tape inwardly, keeping them wound on the hub core. To retract the tape, the user will grasp the handle with one hand and rotate the hub with the knob in the other hand. The rotating hub pulls the tape back into the chamber, with the springs forcing the tape inwardly and keeping it out of contact with the race.

One of the advantages afforded by the present invention is the ease of retracting the tape. Since the tape pays straight out the aperture 44, and no drag or tension-inducing element is required, the tape can be retracted with less effort than in prior devices, and in a shorter time.

While a preferred form of the invention has been shown and described, it will be realized that alterations may be made thereto without departing from the scope of the following claims.

I claim:

1. An electrician's fish tape reel, comprising:

an annular outer race;

a hub disposed interiorly of the race and rotatably mounted thereon, the race and hub cooperatively defining a hollow, fish tape receiving chamber, the fish tape having a plurality of coils when stored in the chamber;

an aperture in the outer race through which a fish tape may protrude from the chamber to the exterior of the reel; and spring means disposed within said chamber for biasing all coils of a fish tape within said chamber away from the outer race and for preventing contact between any coil of the fish tape and the outer race.

2. The fish tape reel of claim 1 wherein the hub comprises a circular core defining the interior periphery of the fish tape receiving chamber.

3. The fish tape reel of claim 2 further comprising two radial walls adjoining lateral edges of the core to form a generally U-shaped cross-section and extending toward the outer race to define the sides of the fish tape receiving chamber.

4. The fish tape reel of claim 3 wherein the outer race has extensions engaging the radial walls of the hub.

5. The fish tape reel of claim 1 wherein the race includes a handle fixed to the outer surface thereof.

6. The fish tape reel of claim 5 further characterized in that said aperture is formed at the intersection of the handle and the race.

7. The fish tape reel of claim 1 further comprising a knob attached to the hub.

8. The fish tape reel of claim 7 wherein the knob is pivotably attached to the hub and movable between a raised operating position, wherein it can be used to rotate the hub on the race, and a storage position.

9. The fish tape reel of claim 8 further comprising a socket formed in the hub for receiving the knob when in the storage position.

10. The fish tape reel of claim 8 further comprising a channel formed in the hub for receiving at least a portion of the knob when in the operating position.

11. An electrician's fish tape reel, comprising an internal hub rotatably mounted within an annular outer race with a fish tape having a plurality of coils when stored in the reel, the coils being radially-biased inwardly by spring means to keep all coils of the fish tape wound on the hub and to prevent contact between any coil of the fish tape and the outer race, the fish tape being payed out of the reel through an aperture in the outer race.

12. The fish tape reel of claim 11 further comprising a handle fixed to the outer race.

13. The fish tape reel of claim 11 wherein the aperture is fixed relative to the race.

14. The fish tape reel of claim 11 further comprising a knob attached to the hub.

15. The fish tape reel of claim 14 wherein the knob is pivotably attached to the hub and movable between a raised operating position, wherein it can be used to rotate the hub on the race, and a storage position.

16. The fish tape reel of claim 15 further comprising a socket formed in the hub for receiving the knob when in the storage position.

17. The fish tape reel of claim 15 further comprising a channel formed in the hub for receiving at least a portion of the knob when in the operating position.

* * * * *